United States Patent [19]

Patula

[11] 4,406,143

[45] Sep. 27, 1983

[54] RETURN PASS PRACTICE FOR THE HIGH MILL OF A SEAMLESS-PIPE MILL

[75] Inventor: Edward J. Patula, Monroeville, Pa.

[73] Assignee: United States Steel Corporation, Pittsburgh, Pa.

[21] Appl. No.: 333,836

[22] Filed: Dec. 23, 1981

[51] Int. Cl.[3] ..... B21B 17/10

[52] U.S. Cl. ..... 72/209; 72/370

[58] Field of Search ..... 72/97, 208, 209, 229, 72/368, 370

[56] References Cited

U.S. PATENT DOCUMENTS 529,910 11/1894 Horovsky ..... 72/209

4,178,789 12/1979 Ruff ..... 72/209

*Primary Examiner*—Francis S. Husar

*Assistant Examiner*—Jonathan L. Scherer

*Attorney, Agent, or Firm*—Arthur J. Greif

[57] ABSTRACT

A pierced billet is fed to a plug rolling mill, wherein the first rolling pass is effected in conventional manner, i.e. the shell is rammed over a forming plug mounted on the front end of the mandrel and then drawn over the plug by the work-rolls. Rather than removing the shell from the mandrel and returning it to the entry side of the mill, the second pass on the shell is effected by reversing the rotation of the work-rolls and pushing the shell back through the reverse rotating work-rolls over the same plug whereby, in effect, the original exit side of the mill now becomes the entry side. This double passing over the same plug is achieved through the use of a newly designed plug, tapered in both directions, wherein the plug is connected to the mandrel so as to transmit the tension force on the plug to the mandrel.

2 Claims, 5 Drawing Figures

RETURN PASS PRACTICE FOR THE HIGH MILL OF A SEAMLESS-PIPE MILL

Figure 1:
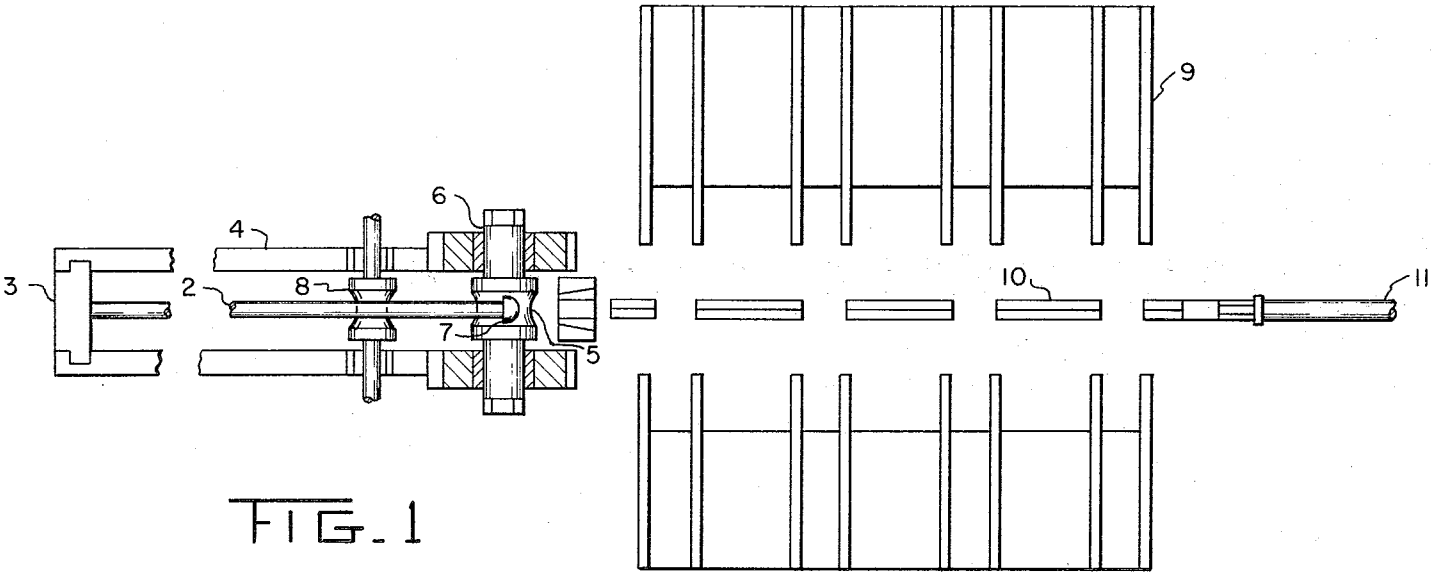

In one method for the production of seamless tubing, a steel billet is pierced to produce a shell which, in turn, is fed to a plug rolling mill at a temperature of the order of 1700°-1900° F. On its entry side, a conventional plug rolling mill is equipped with a trough for receiving the shell and a pusher or ram capable of shoving the shell onto the plug with considerable force. On the delivery side of the work-rolls is a stationary quide table and a water-cooled mandrel bar anchored at the rear of the table. This mandrel bar normally carries a readily removable plug, which during rolling of the shell is situated within the groove of the work-roll. With the shell lying in the feed trough, the ram forces the shell over the plug and the shell is then rapidly drawn over the plug by the friction of the revolving work-rolls. This pulling action over the plugs slightly reduces the wall thickness of the shell, while considerably increasing its length. Once the shell is completely passed through the roll groove, the plug is removed from the mandrel and the direction of the shell is reversed so as to return it to the entry side of the mill. In conventional practice, another plug is then placed on the mandrel, the tube is rotated through an angle of the order of 90°, and thereafter pushed by the ram through the same groove for the second pass in the same direction as the first pass. When the tube has completed its second pass, it is again returned to the entry side of the mill from which it is discharged for further fabrication through a reeling operation, the function of which is to round up and burnish the outside and inside surfaces of the tube.

In this "conventional" method for the production of seamless tubing, it is the plug mill operation which is the "rate controlling" or slowest step in the total operation. One method for significantly reducing this processing time, i.e. by approximately 50%, is shown in U.S. Pat. No. 4,178,789, the disclosure of which is incorporated herein by reference. In this patented process, at the completion of the first pass, the shell is laterally transferred to an adjacent receiving trough and thereafter rolled in a different groove of the same or other work-rolls. Simultaneous with this lateral transfer, another pierced billet is moved into position on the first receiving trough. Thereafter both shells are simultaneously fed through their respectively aligned grooves for receiving a rolling pass whereby two shells are rolled in approximately the same time normally employed for the rolling of one. This latter procedure, however, requires extensive modification of an existing mill or the construction of a completely new mill, in either case requiring significant capital expenditure. The instant process, like that of the patented process, permits a decrease of approximately 50% in the time required for rolling of two passes, and can be achieved with relatively minor modification of the existing mills.

Figure 2:
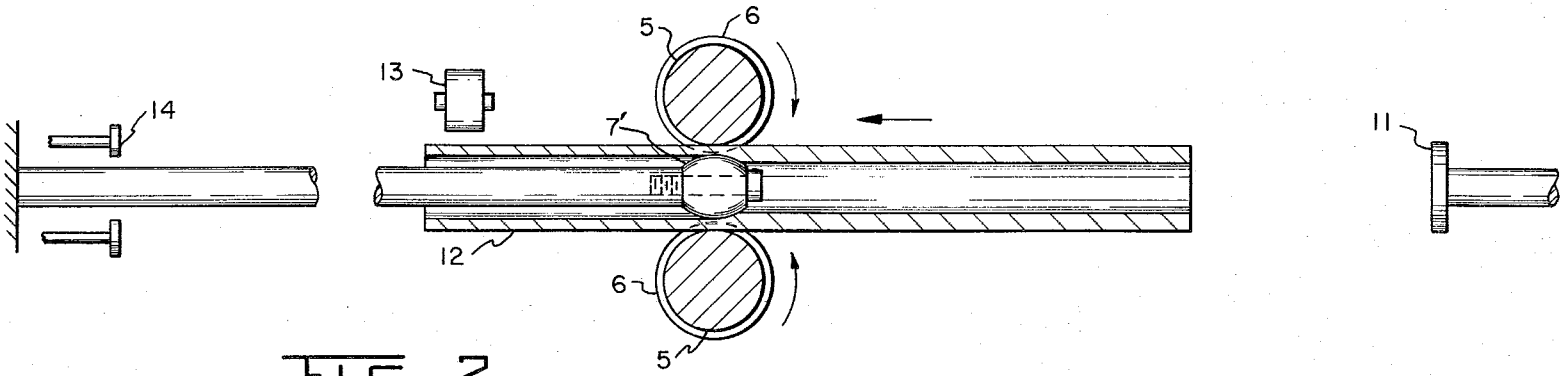
Figure 3A:
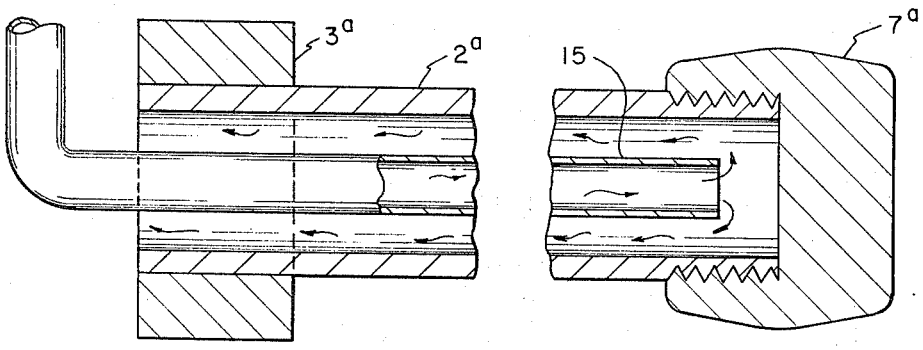
Figure 3B:
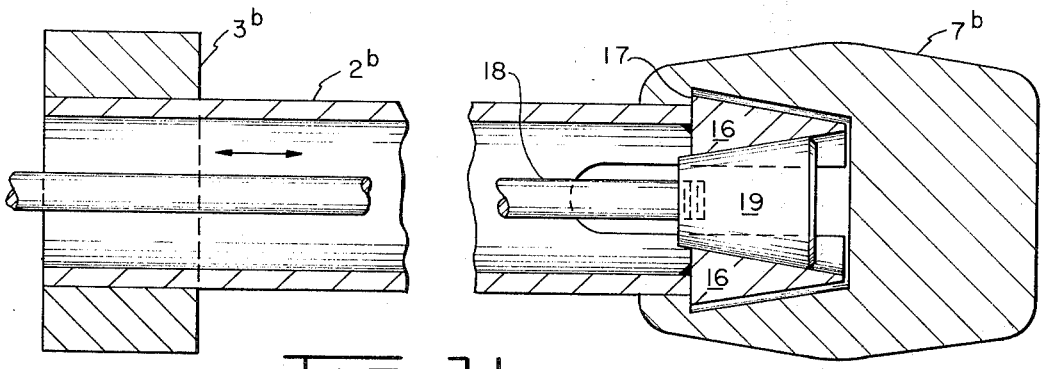
Figure 3C:
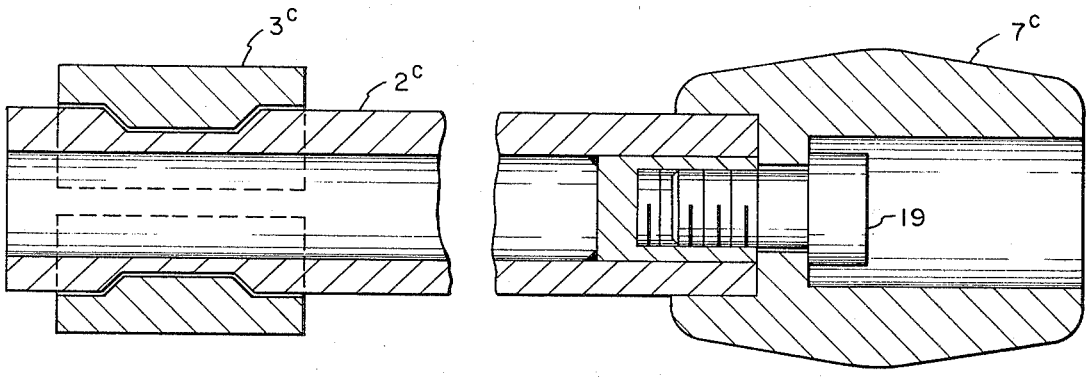

The objects and advantages noted above, as well as other advantages of the instant invention, will become more apparent from a reading of the following description when taken in conjunction with the appended claims and the following drawings in which:

FIG. 1 is a representational drawing of the major elements of a conventional plug rolling mill, FIG. 2 is a representational drawing illustrating how such a conventional mill may be modified to effect the instant process and FIGS. 3*a*, 3*b* and 3*c* show three different methods, as required by the instant invention, for securing the double-tapered plug to the mandrel.

Referring to FIG. 1, a water-cooled mandrel bar 2 is anchored in support 3 at the rear of stationary guide table 4. Each mandrel bar projects through a series of guides (not shown) lined up one behind the other directly in back of groove 5 of work roll 6. The terminus of the mandrel bar is fitted with a plug 7 having an outer diameter somewhat larger than that of the mandrel bar, so as to provide clearance between the inside of the shell and the mandrel. Stripper roll 8, located at the rear of the work-roll, rotates in a direction opposite to that of the main roll and functions only when the top work-roll (not shown) is in "open pass" or elevated position. Inlet table 9 feeds the heated shell to receiving trough 10. Located behind this trough and aligned therewith is ram 11 which serves to shove the shell over the plug 7 to permit the work-rolls to secure a good bite around the shell. So started, the friction exerted by the revolving work-roll is sufficient to draw the shell rapidly over the plug, slightly reducing its diameter and wall thickness and increasing its length. After the work-roll has gripped the shell, ram 11 retracts to its inactive position. Once the shell has passed through the groove of work-rolls, plug 7, which normally is only seated within the mandrel and is readily removable therefrom, is knocked off the mandrel, the top work-roll is elevated to the "open pass" position and stripper rolls 8 are then elevated both to raise the tube to clear the bottom work-roll 6 and grip the tube to return it to the entry side of the mandrel.

If the "conventional" procedure were to be employed, another plug would then be placed on the mandrel, the shell would be rotated through an angle of approximately 90° and thereafter given a second pass substantially the same as indicated above. The instant invention, departs from this conventional procedure, at the juncture in which the shell has completed its first pass over the plug and prior to the point at which the plug is removed for return of the shell to the entry side of the mill. Thus, the instant invention involves the use of a reversing motor (for the work-rolls) and a double-tapered plug to enable the shell to be rolled in both directions. Referring to FIG. 2, the shell 12 is rotated 90° by rotator 13 (here located on the exit side of the mill, rather than the entry side as in a conventional mill). The return of the shell to the entry side is now effected by work rolls 6 (operated in reverse direction), rather than by stripper rolls 8, which are no longer necessary. Ram 14 pushes the shell over the exit side of doubled-taper plug 7'. Since such a return pass requires that mandrel 2 now be in tension, securing means (as shown in FIG. 3) are provided to transmit the tension force from the plug to the mandrel. After the completion of the return pass, when the shell is totally on the (original) entry side of the mill, it will have received two passes (eliminating the second insertion of the shell) and then may proceed for subsequent processing in the conventional manner.

Although the invention is not limited to a specific means for securing the double-tapered plug to the mandrel, three such embodiments are shown in FIGS. 3*a*, 3*b* and 3*c*, respectively. FIG. 3*a* shows the double-tapered plug $7^a$ fastened by means of threads to mandrel $2^a$, i.e. in a "semi-permanent" attachment, i.e. one in which the plug is not readily removable from the mandrel. Such an arrangement would be employed when the mandrel-plug assembly is designed for more than a few passes, e.g. from four to fifty or even more passes. As a result of such multiple pass use, provision must be made for the removal of heat from the mandrel-plug assembly, i.e. by providing internal pipe 15 for admitting fluid to cool both the plug and the mandrel.

An alternative to the use of a "semi-permanent" attachment is the employment of a quick-disconnect system by which the plug can be readily removed from the mandrel. One such quick-disconnect system is shown in FIG. 3*b*, employing a spring-collar 16 which in its "normal" position is resiliently biased toward the central axis of the mandrel-plug assembly. In this "normal" position, lip 17 of the collar 16 would not restrict plug $7^b$ from readily being pulled (in sliding relation) off the mandrel. When rod 18 is actuated, e.g. hydraulically, for movement toward the exit side of the mill, the rod in turn moves conical wedge 19 to which it is joined, causing collar 16 to expand, whereby lip 17 engages the plug—locking it in place for at least one series of the double-pass procedure of this invention. If no provision were made for cooling of plug, whether internally as shown above or externally by sprays, the plug would generally be removed after one or two such series of passes.

A "semi-permanent" attachment means can be employed without provision for in-situ cooling of the mandrel-plug assembly, if the entire assembly is readily removable such that the assembly can be transferred to a cooling station. Another such "semi-permanent" attachment means is shown in FIG. 3*c* where bolt 19 is used to secure plug $7^c$ to the front portion of mandrel $2^c$. Also shown is movable support collet $3^c$, in which the jaws thereof are opened to provide for the readily removal of the mandrel-plug assembly. Such a movable support is an alternative to the assemblies shown in FIG. 3*a* and 3*b* in which the mandrels $2^a$ and $2^b$ are permanently mounted in supports $3^a$ and $3^b$, respectively.

I claim:

1. In the production of seamless tubing, wherein a shell is transferred to a plug rolling mill and said shell is rolled through work-rolls in a first plug-rolling pass consisting of pushing the shell over a plug attached to a supported mandrel bar, said plug lying within a roll groove of the work rolls, the entry side of said plug being tapered in a direction counter to the travel of said shell, whereby the entirety of said shell is drawn over the plug by the rolling friction of the roll groove, thereafter repeating the rolling operation for at least one additional pass on said shell, the improvement for significantly decreasing the time required for completion of said additional pass, which comprises, (a) subsequent to said first pass, reversing the rotation of said work-rolls, rotating the shell about 90° around its longitudinal axis, and (b) pushing the shell back through said reverse-rotating work-rolls to effect the additional pass over the same plug, said plug being connected to the mandrel so as to transmit the tension force on the plug to the mandrel, the exit side of said plug being provided with a taper in a direction counter to the reverse travel of said shell, whereby said shell is drawn over said plug by said work-rolls to perform said additional pass.

2. The method of claim 1 wherein said additional pass is effected in the same roll groove as said first pass.

* * * * *